US008189743B2

(12) United States Patent
Yuan

(10) Patent No.: US 8,189,743 B2
(45) Date of Patent: May 29, 2012

(54) BLADE DEVICE AND X-RAY IMAGING APPARATUS

(75) Inventor: Ping Yuan, Beijing (CN)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 133 days.

(21) Appl. No.: 12/756,873

(22) Filed: Apr. 8, 2010

(65) Prior Publication Data

US 2010/0260318 A1 Oct. 14, 2010

(30) Foreign Application Priority Data

Apr. 9, 2009 (CN) ..... 2009 1 0134856

(51) Int. Cl.
*G21K 1/04* (2006.01)

(52) U.S. Cl. ..... 378/150; 378/147

(58) Field of Classification Search ..... 378/146–167
See application file for complete search history.

(56) References Cited

U.S. PATENT DOCUMENTS

| | | | | |
|---|---|---|---|---|
| 3,980,407 | A | 9/1976 | Hill | |
| 4,246,488 | A | 1/1981 | Hura | |
| 4,389,730 | A * | 6/1983 | Cutter | 378/153 |
| 4,514,859 | A | 4/1985 | Holzermer | |
| 4,766,603 | A | 8/1988 | Okabe et al. | |
| 4,868,843 | A | 9/1989 | Nunan | |
| 4,868,844 | A | 9/1989 | Nunan | |
| 5,396,534 | A | 3/1995 | Thomas | |
| 6,320,936 | B1 | 11/2001 | Holland, Sr. et al. | |
| 6,850,596 | B2 | 2/2005 | Sundermann et al. | |
| 7,092,489 | B2 | 8/2006 | Li | |
| 7,242,749 | B2 | 7/2007 | Hsieh et al. | |

* cited by examiner

*Primary Examiner* — Hoon Song
(74) *Attorney, Agent, or Firm* — Armstrong Teasdale LLP

(57) ABSTRACT

A blade device for forming a hollow cone-like radiation includes a pair of blade members opposed to each other symmetrically at a fixed inclination angle in a first direction perpendicular to the axis of the cone, a pair of second blade members opposed to each other symmetrically at a variable inclination angle in a second direction perpendicular to the axis of the cone and also perpendicular to the first direction, a pair of lever members fixed respectively at one ends thereof to faces of the pair of second blade members on the side opposite to the mutually confronting side, and lever actuating unit for pivoting the pair of lever members about respective shafts.

17 Claims, 8 Drawing Sheets

3

3
302
304
310a
306
308
400
312c
312d
312 b
310b
312a 306
308
336
338
418
318
416
316
326
622
632
634
606
626
630
624
640
608
628
400

306
336
326
316
416

608
606
622
632
634
626
616
630
624
640
618
628
400

BLADE DEVICE AND X-RAY IMAGING APPARATUS

CROSS REFERENCE TO RELATED APPLICATIONS

This application claims the benefit of Chinese Patent Application No. 200910134856.7 filed Apr. 9, 2009, which is hereby incorporated by reference in its entirety.

BACKGROUND OF THE INVENTION

Embodiments of the present invention relates to a blade device and an X-ray imaging apparatus. Particularly, embodiments of the present invention are concerned with a blade device comprising four blade members to form a hollow cone having both open ends, as well as an X-ray imaging apparatus having the blade device.

An X-ray imaging apparatus has a collimator for adjusting an irradiation field. On an inlet side of the collimator there is disposed a blade device for excluding an off-focal radiation, i.e., X-ray radiated from outside an X-ray focal point.

In the blade device, a hollow cone having both open ends is formed using four X-ray impermeable blade members. The tip of the cone is directed to an X-ray focal point lest X-ray radiated from outside the X-ray focal point should get into the collimator.

The blade device is constructed such that the shape of the cone is adjusted in interlock with the irradiation field adjustment performed by the collimator to always permit optimal exclusion of an off-focal radiation irrespective of whether the irradiation field is large or small (see, for example, column 7 line 66 to column 9 line 19, FIG. 6, FIG. 7, of U.S. Pat. No. 4,246,488).

BRIEF DESCRIPTION OF THE INVENTION

In the blade device which adjusts the shape of a cone in interlock with the irradiation field adjustment performed by the collimator, the number of parts increases due to a complicated construction of the device. Consequently, the blade device is difficult to be reduced in size and the cost thereof becomes high.

Accordingly, embodiments of the present invention provide a blade device simple in construction and easy to be reduced in size, as well as an X-ray imaging apparatus having such a blade device.

In a first aspect of the present invention as means for solving the problem there is provided a blade device for forming a hollow cone-like radiation, comprising: a pair of first blade members opposed to each other symmetrically at a fixed inclination angle in a first direction perpendicular to the axis of the cone; a pair of second blade members opposed to each other symmetrically at a variable inclination angle in a second direction perpendicular to the axis of the cone and also perpendicular to the first direction; a pair of lever members fixed respectively at one ends thereof to faces of the pair of second blade members on the side opposite to the mutually confronting side; and lever actuating unit for pivoting the pair of lever members about respective support shafts.

In a second aspect of the present invention as means for solving the problem there is provided, in combination with the above first aspect, a blade device wherein the lever actuating unit includes: a pair of shaft members supported axially movably and unrotatably, and having outer peripheries formed with thread grooves respectively and being engaged at front end portions thereof with opposite end portions of the pair of lever members respectively; a pair of wheels supported axially unmovably and rotatably, having inner peripheries formed with thread grooves respectively and being threadedly engaged with the pair of shafts respectively; a common entraining member engaged with the pair of wheels; and a driving wheel for driving the entraining member.

In a third aspect of the present invention as means for solving the problem there is provided, in combination with the above second aspect, a blade device wherein the lever actuating unit includes a pair of springs for urging the opposite end portions of the pair of lever members toward the pair of shaft members respectively.

In a fourth aspect of the present invention as means for solving the problem there is provided, in combination with the above second aspect, a blade device wherein the lever actuating unit includes a tension imparting device for imparting tension to the entraining member.

In a fifth aspect of the present invention as means for solving the problem there is provided, in combination with the above fourth aspect, a blade device wherein the tension imparting device includes an idler wheel engaged with the entraining member and a spring for urging the axis of the idler wheel in a direction to expand a loop of the entraining member.

In a sixth aspect of the present invention as means for solving the problem there is provided, in combination with the above fifth aspect, a blade device wherein the wheels are toothed wheels and the entraining member is a toothed belt.

In a seventh aspect of the present invention as means for solving the problem there is provided, in combination with the above first aspect, a blade device wherein the lever actuating unit includes a ring capable of rotating coaxially with the axis of the cone and a pair of cam members formed on an end face of the ring so as to engage opposite end portions of the pair of lever members.

In an eighth aspect of the present invention as means for solving the problem there is provided, in combination with the above seventh aspect, a blade device wherein the lever actuating unit includes a pair of springs for urging the opposite end portions of the pair of lever members toward the cam members respectively.

In a ninth aspect of the present invention as means for solving the problem there is provided, in combination with the above eighth aspect, a blade device wherein the springs are leaf springs.

In a tenth aspect of the present invention as means for solving the problem there is provided an X-ray imaging apparatus having an X-ray tube, a blade device for excluding an off-focal radiation, a collimator for adjusting an irradiation field, and an X-ray receiver, the blade device being adapted to form a hollow cone-like radiation, comprising: a pair of first blade members opposed to each other symmetrically at a fixed inclination angle in a first direction perpendicular to the axis of the cone; a pair of second blade members opposed to each other symmetrically at a variable inclination angle in a second direction perpendicular to the axis of the cone and also perpendicular to the first direction; a pair of lever members fixed respectively at one ends thereof to faces of the pair of second blade members on the side opposite to the mutually confronting side; and lever actuating unit for pivoting the pair of lever members about respective support shafts.

According to the first aspect of the present invention, since the blade device for forming a hollow cone-like radiation comprises a pair of first blade members opposed to each other symmetrically at a fixed inclination angle in a first direction perpendicular to the axis of the cone, a pair of second blade members opposed to each other symmetrically at a variable inclination angle in a second direction perpendicular to the axis of the cone and also perpendicular to the first direction, a pair of lever members fixed respectively at one ends thereof to faces of the pair of second blade members on the side opposite to the mutually confronting side, and lever actuating unit for pivoting the pair of lever members about respective support shafts, the blade device is simple in construction and easy to be reduced in size.

According to the tenth aspect of the present invention, in the X-ray imaging apparatus having an X-ray tube, a blade device for excluding an off-focal radiation, a collimator for adjusting an irradiation field and an X-ray receiver, since the blade device is adapted to form a hollow cone-like radiation and comprises a pair of first blade members opposed to each other symmetrically at a fixed inclination angle in a first direction perpendicular to the axis of the cone, a pair of second blade members opposed to each other symmetrically at a variable inclination angle in a second direction perpendicular to the axis of the cone and also perpendicular to the first direction, a pair of lever members fixed at one ends thereof to faces of the pair of second blade members on the side opposite to the mutually confronting side, and lever actuating unit for pivoting the pair of lever members about respective support shafts, the X-ray imaging apparatus is simple in construction and easy to be reduced in size.

According to the second aspect of the present invention, since the lever actuating unit includes: a pair of shaft members supported axially movably and unrotatably, the pair of shaft members having outer peripheries formed with thread grooves respectively and being engaged at front end portions thereof with opposite end portions of the pair of lever members respectively; a pair of wheels supported axially unmovably and rotatably, the pair of wheels having inner peripheries formed with thread grooves respectively and being threadedly engaged with the pair of shafts respectively; a common entraining member engaged with the pair of wheels; and a driving wheel for driving the entraining member, it is possible to simplify the construction of the lever actuating unit.

According to the third aspect of the present invention, since the lever actuating unit includes a pair of springs for urging the pair of lever members toward the pair of shaft members respectively, it is possible to facilitate reciprocative pivoting motions of the pair of lever members with advance and retreat of the pair of shaft members.

According to the fourth aspect of the present invention, since the lever actuating unit includes a tension imparting device for imparting tension to the entraining member, it is possible to ensure engagement between the entraining member and each wheel.

According to the fifth aspect of the present invention, since the tension imparting unit includes an idler wheel engaged with the entraining member and a spring for urging the axis of the idler wheel in a direction to expand a loop of the entraining member, it is possible to impart tension appropriately to the entraining member.

According to the sixth aspect of the present invention, since the wheels are toothed wheels and the entraining member is a toothed belt, it is possible to ensure engagement between each wheel and the entraining member.

According to the seventh aspect of the present invention, since the lever actuating unit includes a ring capable of rotating coaxially with the axis of the cone and a pair of cam members formed on an end face of the ring so as to engage opposite end portions of the pair of lever members, it is possible to simplify the construction of the lever actuating unit.

According to the eighth aspect of the present invention, since the lever actuating unit includes a pair of springs for urging the opposite end portions of the pair of lever members toward the cam members respectively, it is possible to facilitate reciprocative motions of the pair of lever members with rotation of the ring.

According to the ninth aspect of the present invention, since the springs are leaf springs, it is possible to attain the simplification of construction.

DETAILED DESCRIPTION OF THE INVENTION

Embodiments of the present invention will be described below in detail with reference to the drawings. The present invention is not limited to the embodiments described herein.

Figure 1:
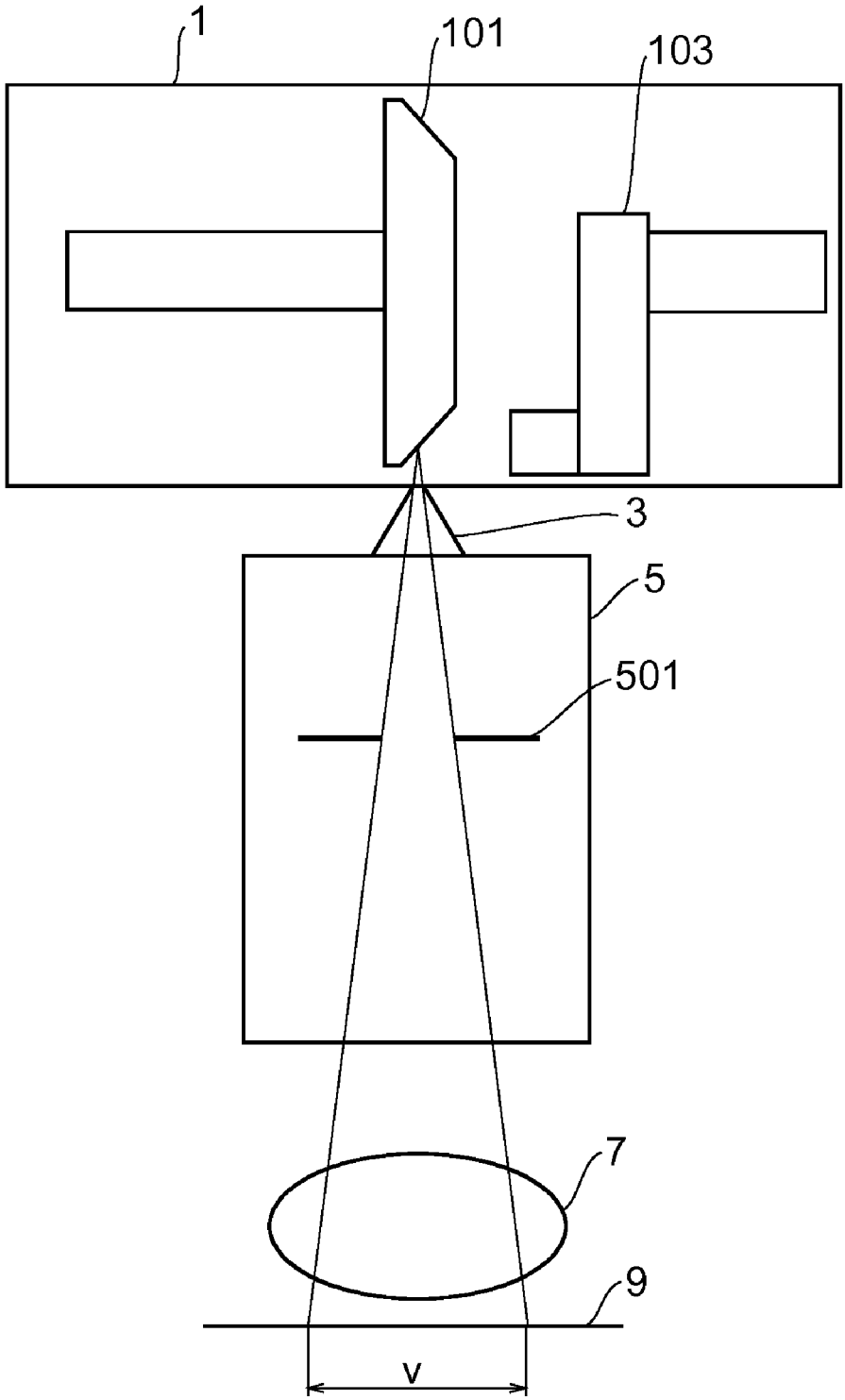
FIG. 1 is a diagram showing the construction of an X-ray imaging apparatus.

FIG. 1 shows schematically the construction of an X-ray imaging apparatus. This apparatus is an example of the mode for carrying out the invention. With the construction of this apparatus, there is shown an example of the mode for carrying out the invention related to the X-ray imaging apparatus.

As shown in FIG. 1, the X-ray imaging apparatus includes an X-ray tube 1, a blade device 3 for excluding an off-focal radiation, a collimator 5 for adjusting an irradiation field, and an X-ray receiver 9. The X-ray tube 1 is an example of the X-ray tube defined in the present invention. The blade device 3 is an example of the blade device defined in the present invention. The collimator 5 is an example of the collimator defined in the present invention. The X-ray receiver 9 is an example of the X-ray receiver defined in the present invention.

The X-ray tube 1 includes an anode 101 and a cathode 103. X-ray is emitted from a collision point (focal point) of electrons which are released from the cathode 103 toward the anode 101. The X-ray emitted from the X-ray tube 1 is radiated to an object 7 to be radiographed through the blade device 3 and the collimator 5. The X-ray which has passed through the object 7 is received by the X-ray receiver 9.

In the blade device, a hollow cone having both open ends is formed using four X-ray impermeable blade members. The blade device is disposed on an inlet side of the collimator 5 with the cone tip facing the X-ray focal point.

The collimator 5 includes a blade 501 constructed of an X-ray impermeable material, e.g., lead. An X-ray irradiation field V depends on an aperture defined by the blade 501. The aperture of the blade 501 is variable, whereby the irradiation field V of X-ray can be adjusted.

In interlock with adjustment of the irradiation field V, the blade device 3 adjusts the shape of the cone. In interlock with expansion of the irradiation field V, the blade device 3 expands the opening at the cone tip, while in interlock with contraction of the irradiation field V, the blade device 3 narrows the cone tip opening.

Figure 2A:
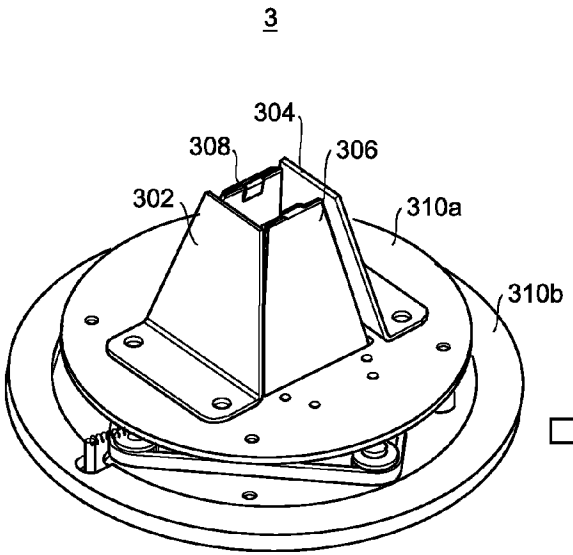
FIGS. 2A, 2B, and 2C are diagrams showing an example of construction of a blade device.
Figure 2B:
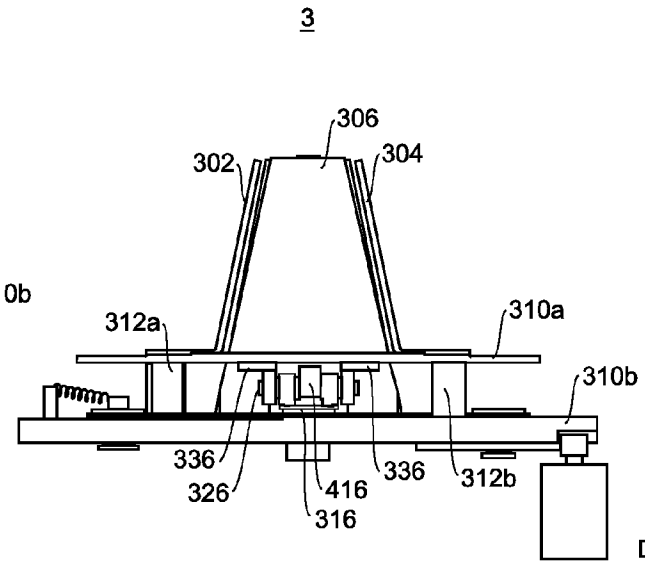
Figure 2C:
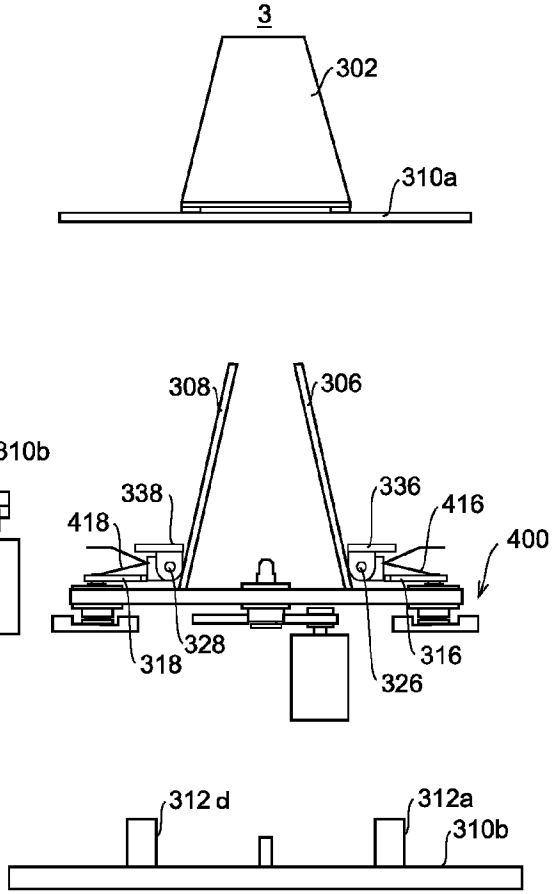

FIGS. 2A-2C show an example of construction of the blade device 3. The blade device 3 is an example of the mode for carrying out the present invention. With the construction of the blade device 3, there is shown an example of the mode for carrying out the invention related to the blade device.

FIG. 2A is a perspective view, FIG. 2B is an elevation, and FIG. 2C is an exploded diagram. FIG. 2C shows, in order from above, a top structure, a middle structure and a bottom structure, of the blade device 3.

As shown in FIGS. 2A-2C, the blade device 3 includes four blade members 302, 304, 306 and 308. For example, the blade members 302, 304, 306 and 308 are trapezoidal plate members constructed of an X-ray impermeable material, e.g., lead. The blade members 302, 304, 306 and 308 form a hollow cone.

The blade members 302 and 304 confront each other symmetrically with respect to the axis of the cone and at a fixed inclination angle. The blade members 302 and 304 are an example of the pair of blade members defined in the present invention.

The blade members 306 and 308 confront each other symmetrically with respect to the axis of the cone and at a variable inclination angle in a direction orthogonal to the mutually confronting direction of the blade members 302 and 304. The blade members 306 and 308 are an example of the second pair of blade members.

The blade device 3 includes a top base member 310*a* and a bottom base member 310*b*. For example, the top base member 310*a* and the bottom base member 310*b* are each a circular plate member constructed of an X-ray impermeable material, e.g., lead.

The top base member 310*a* and the bottom base member 310*b* are connected in parallel with each other through four columnar spacers 312*a*, 312*b*, 312*c* and 312*d*. The top base member 310*a* is formed, at it's center, with a quadrangular aperture for X-ray passage, while the bottom base member 310*b* is formed, at it's center, with a circular aperture for X-ray passage.

The top base member 310*a* supports the blade members 302, 304, 306 and 308. The blade members 302 and 304 are supported by a surface of the top base member 310*a*. The blade members 306 and 308 are supported by a back surface of the top base member 310*a* and project to the surface side through the aperture of the top base member 310*a*.

Base portions of the blade members 302 and 304 are mounted to the surface of the top base member 310*a* along a pair of opposed sides of the quadrangular aperture. One longitudinal ends of lever members 316 and 318 formed by bars are fixed to back surfaces of the top base member 310*a*, namely, to the sides opposite to the confronting sides, of the blade members 306 and 308, and shafts 326 and 328 of the lever members 316 and 318 are supported by bearings 336 and 338 respectively which are disposed on the back surface of the top base member 310*a*.

That is, the blade members 306 and 308 are supported on the back surface of the top base member 310*a* through the shafts 326 and 328 of the lever members 316 and 318 and also through the bearings 336 and 338. Therefore, the blade members 306 and 308 are made variable in inclination angle by pivoting about the shafts 326 and 328.

The tip of a drive section 400 and one ends of leaf springs 416 and 418 come into abutment respectively from below and from above against end portions of the lever members 316 and 318 on the side opposite to the blade members 306 and 308 with respect to the shafts 326 and 328. The lever members 316 and 318 are an example of the pair of lever members defined in the present invention. The drive section 400 is an example of the lever actuating unit defined in the present invention. The leaf springs 416 and 418 are an example of the pair of springs defined in the present invention.

The tip of the drive section 400 moves up and down, causing the blade members 306 and 308 to pivot about the shafts 326 and 328 respectively through the lever members 316 and 318 and thereby causing the inclination angle of the blade members to change. The leaf springs 416 and 418 push the lever members 316 and 318 against the tip of the drive section 400 to keep them in contact.

Figures 3A, 3B, 3C, 3D:
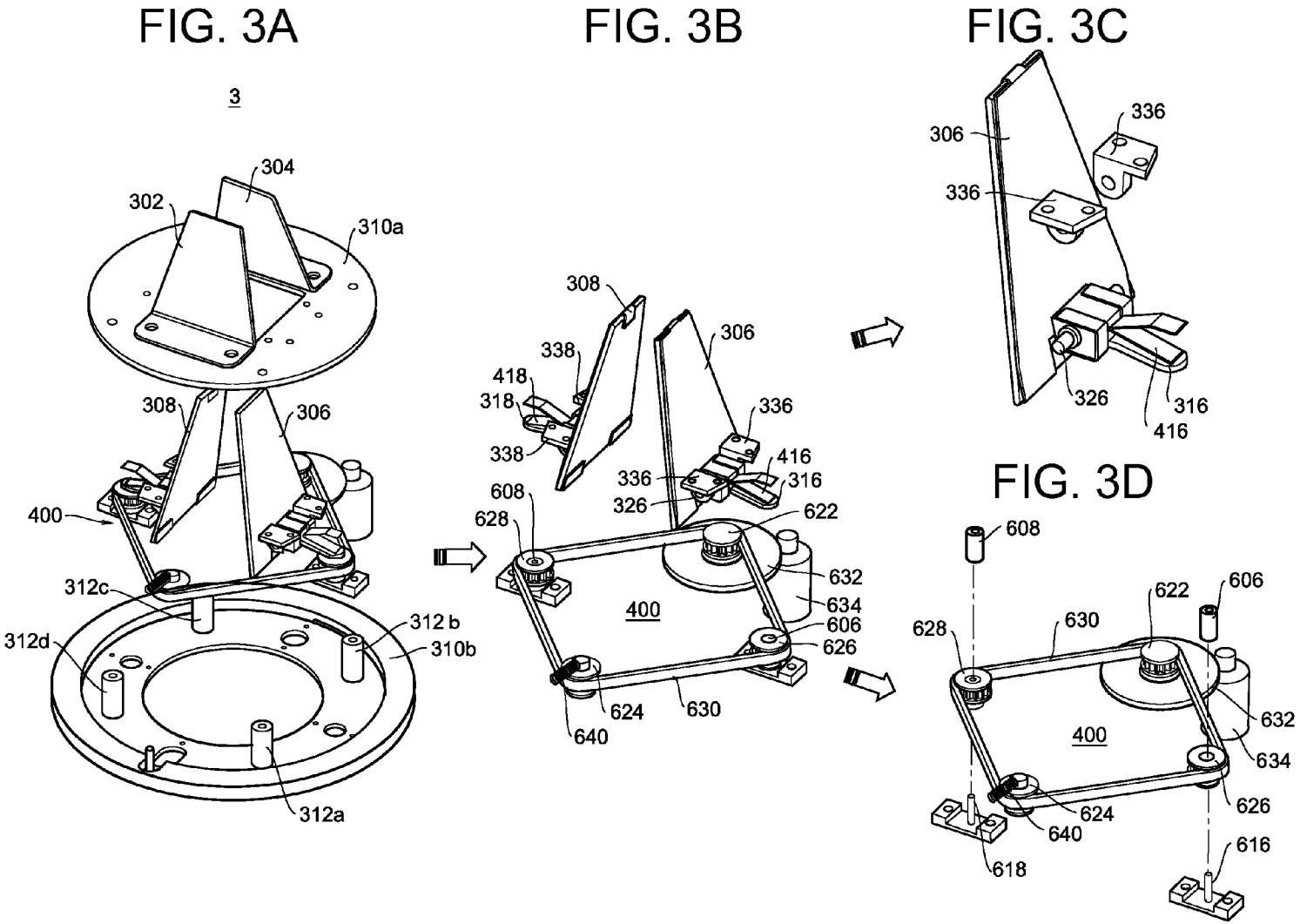
FIGS. 3A, 3B, 3C, and 3D are diagrams showing the construction of the blade device in a disassembled form.

FIGS. 3A-3D show a disassembled state of the blade device 3 is shown in terms of a perspective view. FIG. 3A is an exploded view of the whole of the blade device, FIG. 3B is an exploded view of a middle structure, FIG. 3C is an exploded view of a blade member, and FIG. 3D is an exploded view of the drive section.

As shown in FIGS. 3A-3D, the drive section 400 includes a pair of shafts 606 and 608. Thread grooves are formed in outer peripheries respectively of the shafts 606 and 608. The shafts 606 and 608 are an example of the pair of shaft members defined in the present invention.

The shafts 606 and 608 are supported axially movably and unrotatably by a pair of parallel guide shafts 616 and 618. Base portions of the guide shafts 616 and 618 are fixed to bottom base members 310*b*.

A pair of wheels 626 and 628 having thread grooves formed in inner peripheries thereof are threadedly engaged with the shafts 606 and 608 respectively. The wheels 626 and 628 are toothed wheels having teeth formed on outer peripheries thereof The wheels 626 and 628 are supported axially unmovably and rotatably by the bottom base member 310*b*. The wheels 626 and 628 are an example of the pair of wheels defined in the present invention.

Together with a driving wheel 622 and an idler wheel 624, the wheels 626 and 628 form a square which surrounds the aperture over the bottom base member 310*b*. The driving wheel 622 and the idler wheel 624 are also toothed wheels. The wheels 626 and 628, as well as the driving wheel 622 and the idler wheel 624, are each in a relation of a kinematic pair in the square. Rotary shafts of the four wheels are parallel to one another.

An entraining member 630 is entrained on the four wheels 622, 624, 626 and 628 in an endless manner. Rotation of a motor 634 is transmitted to the driving wheel 622 through a reduction gear 632. A tensile force of a coil spring 640 is applied to the rotary shaft of the idler wheel 624 in a direction away from the driving wheel 622, with tension applied to the entraining member 630, whereby a belt drive device for the wheels 626 and 628 is constituted.

The entraining member 630 is an example of the entraining member defined in the present invention. The driving wheel 622 is an example of the driving wheel defined in the present invention. The idler wheel 624 and the coil spring 640 are an example of the tension imparting device defined in the present invention. The idler wheel 624 is an example of the idler wheel defined in the present invention. The coil spring 640 is an example of the spring defined in the present invention.

The entraining member 630 is not limited to the toothed belt. It may be any other suitable entraining member, e.g., chain, V belt, flat belt, or steel wire. The wheels 622, 624, 626 and 628 may also be wheels having an outer periphery structure matching the entraining member.

Figure 4A:
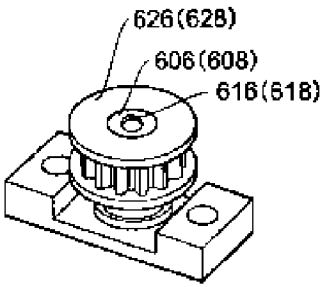
FIGS. 4A, 4B, 4C, 4D, and 4E are diagrams showing a relation among a shaft, a guide shaft and a wheel.
Figure 4B:
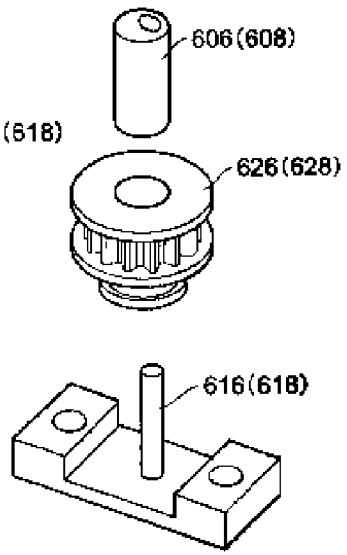
Figure 4C:
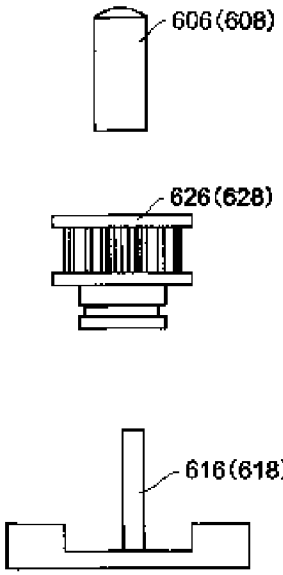
Figure 4D:
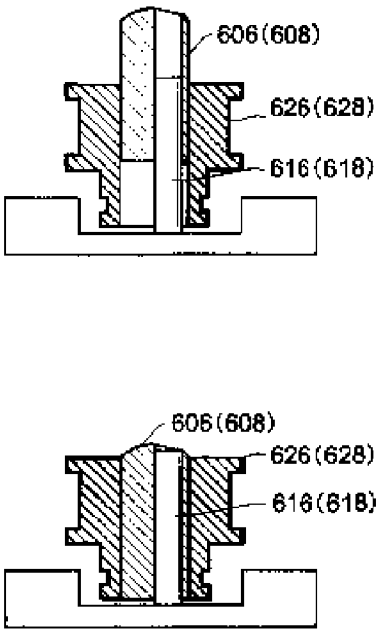
Figure 4E:
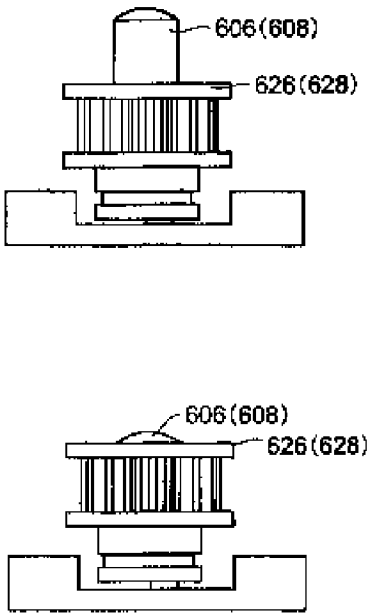

FIGS. 4A-4E a relation among the shaft 606 (608), guide shaft 618 (618) and wheel 626 (628). FIG. 4A is a perspective view showing an assembled state, FIG. 4B is a perspective view showing a disassembled state, FIG. 4C is an elevation showing the disassembled state, FIG. 4D is a sectional view showing a state of operation, and FIG. 4E is an elevation showing the state of operation.

As shown in FIGS. 4A-4E, the shaft 606 (608) is supported by the guide shaft 616 (618) which is an eccentric shaft, and the wheel 626 (628), which are axially unmovable and rotatable, is threadedly engaged with the shaft 606 (608).

In such a construction, when the wheel 626 (628) rotates, the shaft 606 (608) moves linearly along the guide shaft without rotation. The moving direction of the shaft 606 (608) depends on the rotating direction of the wheel 626 (628). For example, the shaft 606 (608) advances with forward rotation of the wheel 626 (628) and retreats with reverse rotation of the wheel 626 (628).

Figure 5B:
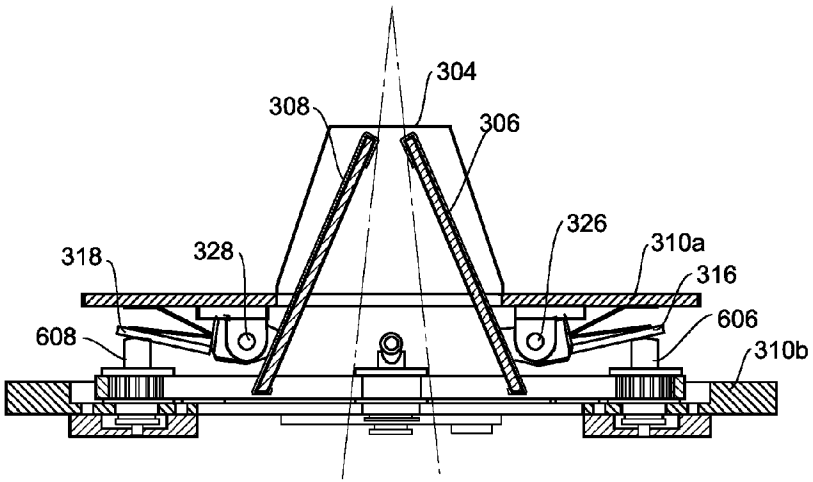
FIGS. 5A and 5B are diagrams showing a change in inclination angle of blade members with advance and retreat of shafts.
Figure 5A:
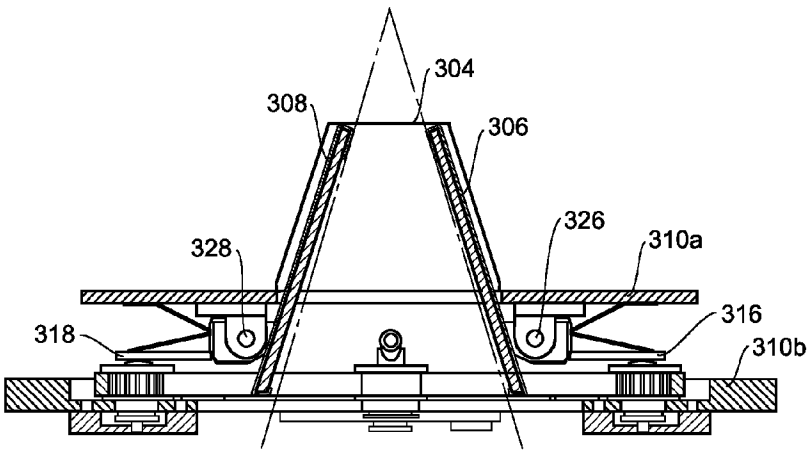

FIGS. 5A and 5B show in what manner the blade members 306 and 308 change in inclination angle with advance and retreat of the shafts 606 and 608. In FIG. 5A, the shafts 606 and 608 are in the most retreated state, in which the blade members 306 and 308 tilt so that the cone tip aperture becomes maximum. In FIG. 5B, the shafts 606 and 608 are in the most advanced state, in which the blades 306 and 308 tilt so that the cone tip aperture becomes minimum.

Figure 6A:
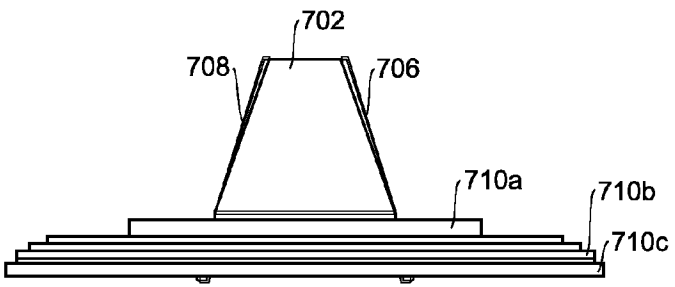
FIGS. 6A, 6B, and 6C are diagrams showing another example of construction of a blade device.
Figure 6B:
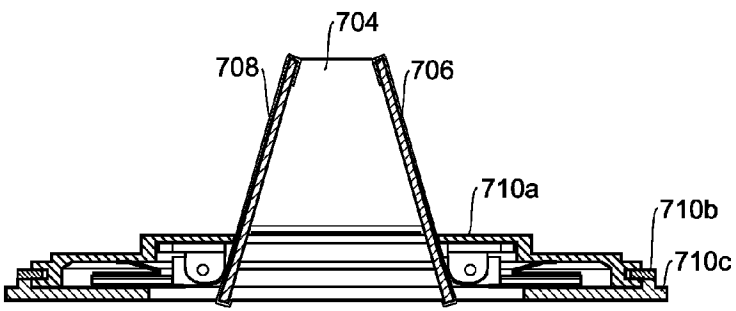
Figure 6C:
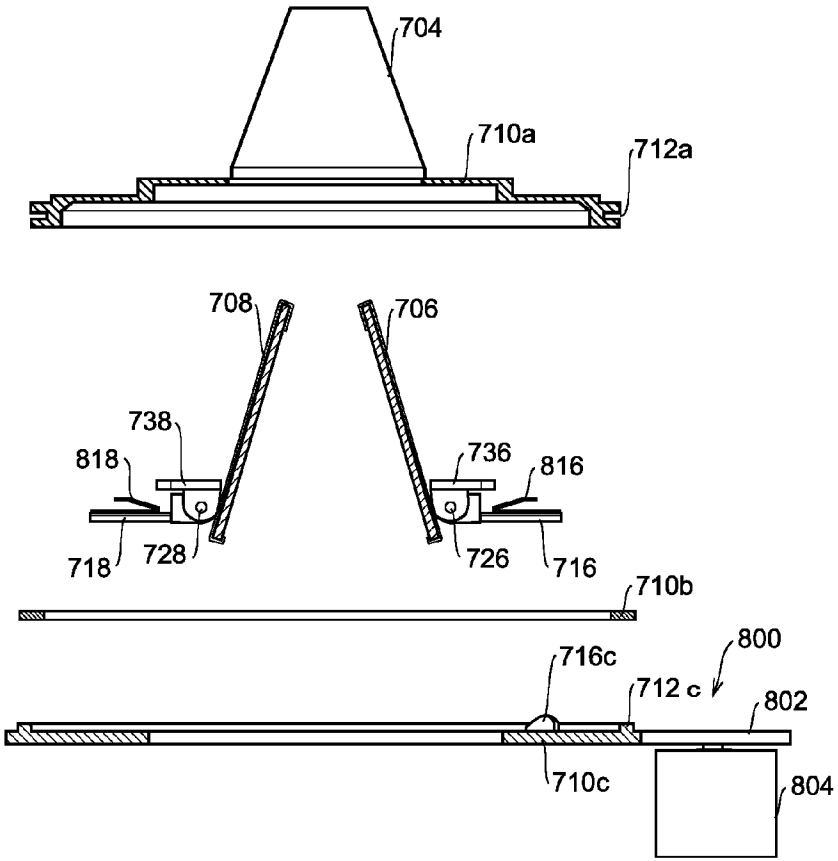

In FIGS. 6A-6C there is shown another example of construction of a blade device 3. The blade device 3 is an example of the mode for carrying out the present invention. With the construction of the blade device 3, there is shown an example of the mode for carrying out the invention related to the blade device.

FIG. 6A is an elevation, FIG. 6B is a sectional view, and FIG. 6C is an exploded view. FIG. 6C shows, in order from above, a top structure, a middle structure and a bottom structure, of the blade device 3. The exploded view of FIG. 6C is of the sectional view of FIG. 6B.

As shown in FIGS. 6A-6C, the blade device 3 includes four blade members 702, 704, 706 and 708. For example, the blade members 702, 704, 706 and 708 are trapezoidal plate members constructed of an X-ray impermeable material, e.g., lead. The blade members 702, 704, 706 and 708 form a hollow cone.

The blade members 702 and 704 confront each other symmetrically with respect to the axis of the cone and at a fixed inclination angle. The blade members 702 and 704 are an example of the first pair of blade members defined in the present invention.

The blade members 706 and 708 confront each other symmetrically with respect to the axis of the cone and at a variable inclination angle in a direction orthogonal to the mutually confronting direction of the blade members 702 and 704. The blade members 706 and 708 are an example of the second pair of blade members defined in the present invention.

The blade device 3 includes a base member 710*a*, a slide ring 710*b* and a base ring 710*c*. For example, the base member 710*a* is a stepped short cylinder constructed of an X-ray impermeable materials, e.g., lead. The base member 710*a* has a quadrangular aperture of X-ray passage formed at a center of an end face of an upper-step portion. Also, the base member 710*a* has a groove 712*a* formed throughout the whole circumference of a lower-step portion thereof The depth direction of the groove 712*a* corresponds to the radial direction of the base member 710*a*.

The base member 710*a* supports the blade members 702, 704, 706 and 708. The blade members 702 and 704 are supported on a surface side of an end face of the base member 710*a*. The blade members 706 and 708 are supported on a back side of the end face of the base member 710*a* and project to the surface side through the aperture of base member 710*a*.

Base portions of the blade members 702 and 704 are mounted to the surface of the base member 710*a* along a pair of opposed sides of the quadrangular aperture. On the back side of the base member 710*a*, one longitudinal ends of lever members 716 and 718 formed by bars are fixed to back surfaces, namely, to the sides opposite to the confronting sides, of the blade members 706 and 708, and shafts 726 and 728 of the lever members 716 and 718 are supported respectively by bearings 736 and 738 disposed on the back surface of the base member 710*a*.

That is, the blade members 706 and 708 are supported on the back surface of the base member 710*a* through the shafts 726 and 728 of the lever members 716 and 718 and further through the bearings 736 and 738. Therefore, the blade members 706 and 708 are made variable in inclination angle by pivoting about the shafts 726 and 728.

The slide ring 710*b* is a thin plate-like ring. An inside portion of the slide ring 710*b* is loosely fitted in the groove 712*a*, while an outside portion thereof protrudes from the groove 712*a*. The base ring 710*c* is a plate-like ring having a diameter larger than the outside diameter of the base member 710*a*. The aperture of the ring serves as an X-ray passing aperture.

An upwardly raised, concentric rib 712*c* is formed on an end face of the base ring 710*c*, and the protruding portion of the ring 710*b* is connected to the rib 712*c*. As a result, the base ring 710*c* is rotatable coaxially with respect to the base member 710*a*. The base ring 710*c* is an example of the ring defined in the present invention.

The base ring 710*c* includes a pair of cams 716*c* and 718*c* formed on the end face of the base ring at positions inside the rib 712*c*. However, the cam 718*c* is positioned on this side of the section and is therefore not shown. The cams 716*c* and 718*c* are inverted V-shaped projections projecting upward from the end face of the base ring 710*c* and inclined in the circumferential direction of the base ring 710*c*.

The base ring 710*c* having the cams 716*c* and 718*c* constitutes a drive section 800. The drive section 800 is an example of the lever actuating unit defined in the present invention. The cams 716*c* and 718*c* are an example of the pair of cam members defined in the present invention.

The base ring 710*c* is a gear having a toothed outer periphery and is driven by a motor 804 through a gear 802 meshing with the base ring gear. The operation of the base ring 710*c* by the motor 804 may be done by utilizing friction of a roller or a belt instead of the engagement between the gears.

The cams 716*c* and 718*c* of the drive section 800 are abutted from below against end portions of the lever members 716 and 718 respectively on the side opposite to the blade members 706 and 708 with respect to the shafts 726 and 728, while one ends of leaf springs 816 and 818 are abutted from above against the end portions. The leaf springs 816 and 818 push the lever members 716 and 718 against the cams 716*c* and 718*c* respectively to keep both in contact with each other. The lever members 716 and 718 are an example of the pair of lever members defined in the present invention. The leaf springs 816 and 818 are an example of the pair of leaf springs defined in the present invention.

Figure 7A:
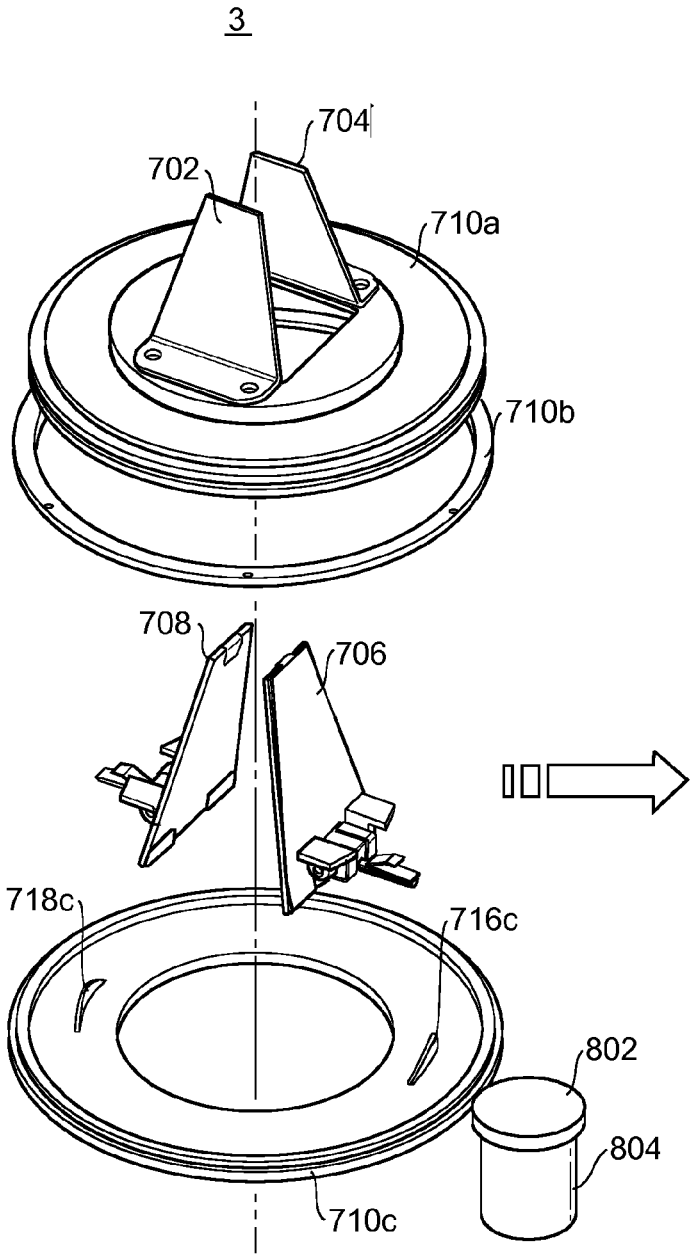
FIGS. 7A and 7B are diagrams showing the construction of the blade device in a disassembled form.
Figure 7B:
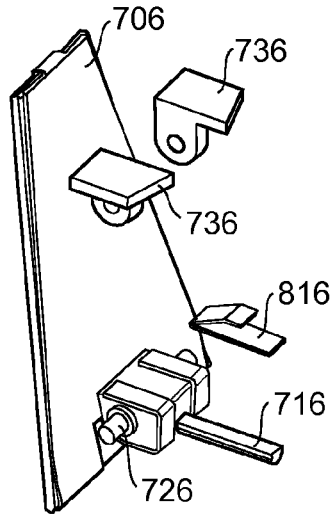

FIGS. 7A and 7B show the disassembled state of the blade device 3 in terms of a perspective view. FIG. 7A is an exploded view of the whole of the blade device and FIG. 7B is an exploded view of a blade member. As shown in FIGS. 7A and 7B, the base ring 710*c* has a pair of cams 716*c* and 718*c*.

The height of the cams 716*c* and 718*c* for lifting the opposite end sides of the lever members 716 and 718 changes with rotation of the base ring 710*c*. That is, the base ring 710*c* provided with the cams 716*c* and 718*c* constitute a so-called scroll cam device, and the amount of rotation of each of the lever members 716 and 718 is changed by the change in height of each of the cams 716*c* and 718*c* which results from rotation of the base ring 710*c*.

Figure 8B:
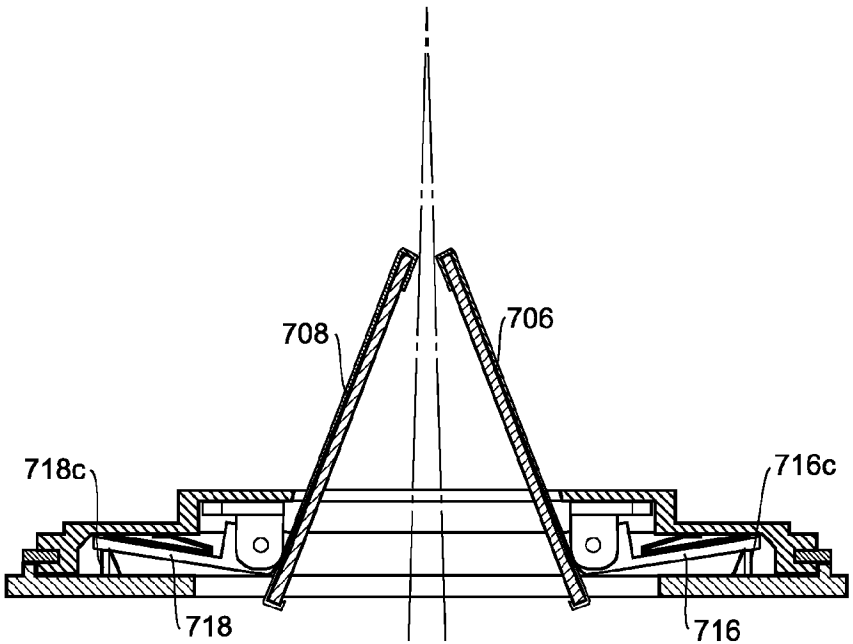
FIGS. 8A and 8B are diagrams showing a change in inclination angle with rotation of a ring.
Figure 8A:
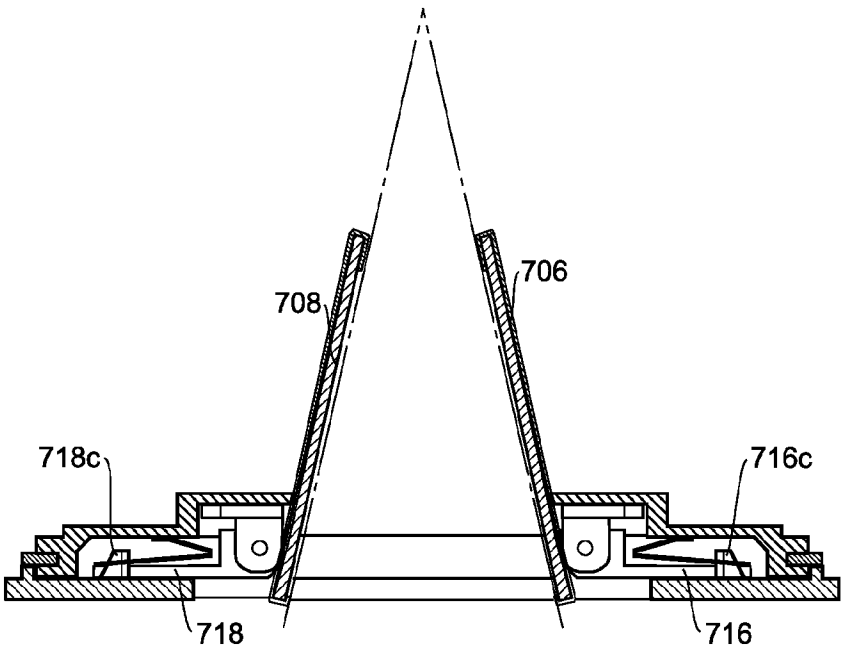

FIGS. 8A and 8B show a change in inclination angle of the blade members 706 and 708 with rotation of the base ring 710*c*. FIG. 8A shows a state in which the base ring 510*c* has rotated so that the height of each of the cams 716*c* and 718*c* becomes the lowest. In this state, the blade members 706 and 708 tilt so that the cone tip aperture becomes maximum. FIG. 8B shows a state in which the base ring 710*c* has rotated so that the height of each of the cams 716*c* and 718*c* becomes the highest. In this state, the blade members 706 and 708 tilt so that the cone tip aperture becomes minimum.

What is claimed is:

1. A blade device for use in forming a hollow cone-like radiation, the blade device comprising:

a pair of first blade members opposed to each other symmetrically at a fixed inclination angle in a first direction perpendicular to an axis of the cone;

a pair of second blade members opposed to each other symmetrically at a variable inclination angle in a second direction perpendicular to the axis of the cone, the second direction perpendicular to the first direction;

a pair of lever members each fixed respectively at a first end thereof to a respective face of each the pair of second blade members on the side opposite to a mutually confronting side; and a lever actuating unit configured to pivot the pair of lever members about respective support shafts, wherein the lever actuating unit comprises:

a pair of shaft members supported axially movably and unrotatably, the pair of shaft members having outer peripheries formed with thread grooves respectively and being engaged at front end portions thereof with a second end of each of the pair of lever members respectively;

a pair of wheels supported axially unmovably and rotatably, the pair of wheels having inner peripheries formed with thread grooves respectively and being threadedly engaged with the pair of shafts respectively;

a common entraining member engaged with the pair of wheels; and a driving wheel configured to drive the entraining member.

2. A blade device according to claim 1, wherein the lever actuating unit further comprises a pair of springs configured to urge the second end of each of the pair of lever members toward the pair of shaft members respectively.

3. A blade device according to claim 1, wherein the lever actuating unit further comprises a tension imparting device configured to impart tension to the entraining member.

4. A blade device according to claim 3, wherein the tension imparting device comprises:

an idler wheel engaged with the entraining member; and a spring configured to urge an axis of the idler wheel in a direction to expand a loop of the entraining member.

5. A blade device according to claim 4, wherein the pair of wheels, the driving wheel, and the idler wheel each comprises a toothed wheel, and the entraining member is a toothed belt.

6. A blade device for use in forming a hollow cone-like radiation, the blade device comprising:

a pair of first blade members opposed to each other symmetrically at a fixed inclination angle in a first direction peapendicular to an axis of the cone;

a pair of second blade members opposed to each other symmetrically at a variable inclination angle in a second direction perpendicular to the axis of the cone, the second direction perpendicular to the first direction;

a pair of lever members each fixed respectively at a first end thereof to a respective face of each the pair of second blade members on the side opposite to a mutually confronting side; and a lever actuating unit configured to pivot the pair of lever members about respective support shafts, wherein the lever actuating unit comprises:

a ring configured to rotate coaxially with the axis of the cone; and a pair of cam members formed on an end face of the ring so as to engage a second end of each of the pair of lever members.

7. A blade device according to claim 6, wherein the lever actuating unit further comprises a pair of springs configured to urge the second end of each of the pair of lever members toward the cam members respectively.

8. A blade device according to claim 7, wherein the pair of springs comprises a pair of leaf springs.

9. An X-ray imaging apparatus comprising:

an X-ray tube;

a collimator configured to adjust an irradiation field;

an X-ray receiver; and a blade device configured to form a hollow cone-like radiation for excluding off-focal irradiation, the blade device comprising:

a pair of first blade members opposed to each other symmetrically at a fixed inclination angle in a first direction perpendicular to an axis of the cone;

a pair of second blade members opposed to each other symmetrically at a variable inclination angle in a second direction perpendicular to the axis of the cone, the second direction perpendicular to the first direction;

a pair of lever members each fixed respectively at a first end thereof to a respective face of each the pair of second blade members on the side opposite to a mutually confronting side; and a lever actuating unit configured to pivot the pair of lever members about respective support shafts, wherein the lever actuating unit comprises:

a pair of shaft members supported axially movably and unrotatably, the pair of shaft members having outer peripheries formed with thread grooves respectively and being engaged at front end portions thereof with, opposite end portions of the pair of lever members respectively a pair of wheels supported axially unmovably and rotatably, the pair of wheels having inner peripheries formed with thread grooves respectively and being threadedly engaged with the pair of shafts respectively;

a common entraining member engaged with the pair of wheels; and a driving wheel configured to drive the entraing member.

10. An X-ray imaging apparatus according to claim 9, wherein the lever actuating unit further comprises a pair of springs configured to urge a second end of each of the pair of lever members toward the pair of shaft members respectively.

11. An X-ray imaging apparatus according to claim 9, wherein the lever actuating unit further comprises a tension imparting device configured to impart tension to the entraining member.

12. A blade device according to claim 11, wherein the tension imparting device comprises:

an idler wheel engaged with the entraining member; and a spring configured to urge an axis of the idler wheel in a direction to expand a loop of the entraining member.

13. An X-ray imaging apparatus according to claim 12, wherein the pair of wheels, the driving wheel, and the idler wheel each comprises a toothed wheel, and the entraining member is a toothed belt.

14. An X-ray imaging apparatus comprising:

an X-ray tube;

a collimator configured to adjust an irradiation field;

an X-ray receiver; and a blade device configured to form a hollow cone-like radiation for excluding off-focal irradiation, the blade device comprising:

a pair of first blade members opposed to each other symmetrically at a fixed inclination angle in a first direction perpendicular to an axis of the cone;

a pair of second blade members opposed to each other symmetrically at a variable inclination angle in a second direction perpendicular to the axis of the cone, the second direction perpendicular to the first direction;

a pair of lever members each fixed respectively at a first end thereof to a respective face of each the pair of second blade members on the side opposite to a mutually confronting side; and a lever actuating unit configured to pivot the pair of lever members about respective support shafts, wherein the lever actuating unit comprises:

as ring configured to rotate coaxially with the axis of the cone; and a pair of cam members formed on an end face of the ring so as to engage a second end of each of the pair of lever members.

15. An X-ray imaging apparatus according to claim 14, wherein the lever actuating unit further comprises a pair of springs configured to urge the second end of each of the pair of lever members toward the cam members respectively.

16. An X-ray imaging apparatus according to claim 15, wherein the pair of springs comprises a pair of leaf springs.

17. A method of assembling a blade device for use in forming a hollow cone-like radiation, the method comprising:

positioning a pair of first blade members opposed to each other symmetrically at a fixed inclination angle in a first direction perpendicular to an axis of the cone;

positioning a pair of second blade members opposed to each other symmetrically at a variable inclination angle in a second direction perpendicular to the axis of the cone, the second direction perpendicular to the first direction;

fixedly coupling each of a pair of lever members at a respective first end thereof to a respective face of each of the pair of second blade members on the side opposite to a mutually confronting side;

coupling a lever actuating unit to the pair of lever members, the lever actuating unit configured to pivot the pair of lever members about respective support shafts;

coupling a pair of shaft members to the lever members, the pair of shaft members supported axially movably and unrotatably and having outer peripheries formed with thread grooves respectively and being engaged at front end portions thereof with a second end of each of the pair of lever members respectively;

coupling a pair of wheels to the pair of shafts, the pair of wheels supported axially unmovably and rotatably and having inner peripheries formed with thread grooves respectively and being threadedly engaged with the pair of shafts respectively;

coupling a common entraining member to the pair of wheels; and coupling a driving heel to the entraining member.

* * * * *